United States Patent [19]

Donan, Jr.

[11] 4,187,040

[45] Feb. 5, 1980

[54] MINE ROOF BOLT SPIKE CHEMICAL DISPENSER ASSEMBLY

[75] Inventor: David C. Donan, Jr., Hopkins County, Ky.

[73] Assignee: Waiamea Company, Inc., Manitou, Ky.

[21] Appl. No.: 911,225

[22] Filed: May 31, 1978

[51] Int. Cl.[2] ..... E21D 21/00

[52] U.S. Cl. ..... 405/259; 405/261; 206/222

[58] Field of Search ..... 61/45 B; 85/1 R, 63, 85/69; 405/259, 260, 261; 206/222, 231

[56] References Cited

U.S. PATENT DOCUMENTS

| | | | |
|---|---|---|---|
| 2,952,129 | 9/1960 | Dempsey | 61/45 B |
| 3,877,235 | 4/1975 | Hill | 405/261 |
| 3,940,941 | 3/1976 | Libert et al. | 61/45 B |
| 4,051,681 | 10/1977 | Yaros | 61/45 B |

*Primary Examiner*—David H. Corbin
*Attorney, Agent, or Firm*—Price and Caslin

[57] ABSTRACT

An expansion type mine roof bolt assembly is shown that is to be installed in a roof bolt hole in a mine roof. The roof bolt has a stem that is fitted on a base plate, and it includes an expansion shell unit that expands when the bolt is tightened. A chemical dispenser assembly is fitted onto the bolt stem. The chemical dispenser assembly includes a base flange unit with an elongated sleeve that is threaded to the bolt stem. A hollow cylindrical chemical container is supported on the base flange unit. An elongated pressure sleeve unit is interposed between the expansion shell unit and the top portion of the chemical container so that when the bolt is tightened the pressure sleeve transmits a rupture force to the bottom portion of the chemical container to cause the contents of the container to be expelled into the roof bolt hole for sealing the base of the roof bolt hole. The base flange unit may include perforations and spike members for piercing the bottom portion of the chemical container. An optional accessory is a protective U washer that may be temporarily interposed between the spike members and the bottom portion of the chemical container to prevent inadvertent rupturing during non-use of the roof bolt assembly.

9 Claims, 12 Drawing Figures

MINE ROOF BOLT SPIKE CHEMICAL DISPENSER ASSEMBLY

BACKGROUND OF THE INVENTION

1. Field of the Invention

This invention relates to an expansion type mine roof bolt assembly and particularly to a chemical dispenser assembly that is added to the roof bolt to seal the base of the roof bolt hole in the roof strata from the adverse effects of moisture and oxygen in the air.

2. Description of the Prior Art

Mine roof bolts and rock bolts have been used in mines and tunnels to support roof and interior structures of mines and tunnels for a number of years. Roof bolts are used to strengthen the load bearing characteristics of roof and adjacent strata, particularly in stratified roof material. Certain types of mine roof strata, such as shale and clay type strata are vulnerable to degradation from the adverse reaction of said strata with moisture and oxygen present in the ambient mine air. Strata with only a small content of certain clays such as the montmorillonites and illites are very sensitive to contact with humid mine air. The moisture expands the clays causing a loss of cohesion in the strata. Pyrites and other minerals when present in the exposed roof strata react with the oxygen from the air and also react with both moisture and oxygen to change their chemical and physical form, destroying their binding and load bearing characteristics. When bolt holes are drilled in the mine roof strata the newly exposed strata is vulnerable to exposure to ambient mine air, also the newly exposed strata may expel innate gases and moisture trapped in the roof strata in its natural condition, such loss of gases and moisture also have a detrimental effect on the load bearing characteristics of the roof strata; also some of the gases are noxious and toxic and pose a safety hazard to mine operations.

By either coating the exposed bolt hole strata with a protective coating, or filling in the voids in the bolt hole with cementing or filler type material, the strata may be protected from the ambient mine air. A liquid or foam material such polyurethane may be used to coat the surfaces of the borehole or fill the voids in the borehole, or to seal the base of the borehole. The insertion of granular chemical substances such as desiccants (silica gel etc) and oxidants (iron filings etc) into the bore hole provide a means of counteracting the moisture and oxygen present in the mine air confined in the bore hole, if the base of the bore hole is sealed from the entrance of additional mine air. References to prior art is made to U.S. Pat. Nos. 25,869 and 2,829,502. Expansion type shell units are commonly used in roof control by mine roof bolt assemblies. The expansion shell type roof bolt assembly consists of a bolt up to several feet in length, a base plate with a hole in it through which the roof bolt is inserted, and an expansion shell unit which is threaded on the threaded upper end of the roof bolt stem. When the roof bolt assembly is inserted into the bore hole in the mine roof, the bolt is tightened, by rotation, causing the expansion shell to expand and anchor the bolt assembly in the bolt hole and binding the stratified roof material tightly together. The expansion shell usually consists of a threaded wedge nut, a cylindrical shell slotted to form wings that are semi-rigid, and a bail or hanger that serves both as a stabilizer to prevent rotation of the shell in the hole when it is first rotated, and the bail also holds the wings of the expansion wings of the shell in a fixed position with relation to the top of the bolt stem, so that as the wedge nut is rotated, the wedge advances downward on the treaded portion of the roof bolt stem which forces the expansion wings outward against the sides of the bolt hole causing the shell to anchor the assembly in place.

There are various types of chemical roof bolt assemblies which usually consist of a sealed pouch containing a chemical cement that sets when the pouch is ruptured and the chemicals mixed by rotation of the bolt stem within the bolt hole. The chemicals solidify filling the voids with the chemical cement.

SUMMARY OF THE INVENTION

An object of the invention is to provide a means of sealing the interior surface of a mine roof bolt hole to protect the strata from exposure to ambient mine air.

It is another object of the invention to provide a means to seal the base of the mine roof bolt hole so that the air within the hole is confined and prevent the entrance of additional mine air into the bore hole.

It is another object of the invention to provide a means to seal the surfaces of the exposed roof strata to prevent the excape of gases and moisture confined under pressure in their natural state in the mine roof strata and/or prevent the escape of the gases and moisture from the hole by sealing the base of the hole to prevent their escape into the mine workings.

It is another object of the invention to provide a means of introducing chemical substances into a confined bolt hole, such substances as desiccants and oxidants counteract the presence of moisture and oxygen in the air confined within the bolt hole.

It is another object of the invention to provide a spike chemical dispenser assembly to be used in connection with an expansion type roof bolt assembly, that will provide a means of introducing chemical substances into the bolt hole in a sealed container, and then to automatically release or dispense the chemical substances from the container into the bolt hole as the roof bolt assembly is tightened in the bolt hole.

It is another object of the invention to provide a means of attaching a sealed chemical container containing chemicals confined under pressure or not under pressure to a mine roof bolt stem prior to insertion into the bolt hole, and a means of releasing the chemicals from the sealed container into the bolt hole, automatically as the bolt is tightened in the bolt hole. Briefly described the invention provides a means and method of introducing chemicals in a sealed container into the mine roof bolt hole and a means of automatically releasing the chemicals into the bolt hole by the action of tightening the roof bolt assembly in the mine roof bolt hole. The chemicals released into the bolt hole may either (1) fill the voids of the bolt hole, (2) seal the surfaces exposed in the bolt hole, (3) plug or seal the base of the bolt hole with the roof bolt assembly installed, or (4) counteract or neutralize the effect of moisture and oxygen confined within the bolt hole when it is sealed at its base.

The invention is related to mine roof bolt assemblies and more particularly to the spike chemical dispenser assembly for introducing chemicals into roof bolt holes to protect exposed mine roof strata from the adverse effects of exposure to ambient mine air, and to prevent the expulsion of innate gases and moisture from the natural strata exposed in the bolt hole.

The mine roof bolt assembly with the spike chemical dispenser assembly includes a base plate, a roof bolt extending through a hole in the base plate, the spike chemical dispenser assembly or unit attached to the threaded upper part of the roof bolt stem, an expansion shell unit with wedge nut and bail, also threaded onto the upper end of the roof bolt stem.

The spike chemical dispenser assembly consists of (1) a base spike flange unit with upright spikes and support arms formed in the flange base. The flange is formed with additional slots or holes in the inner portion of the flange, a tubular sleeve attached to the flange, and a threaded nut attached to the sleeve, (2) an optional protective "U" type washer that may be placed on top of the spikes to prevent accidental rupturing of the chemical container prior to installation of the assembly in the bolt hole; the protective "U" washer is removed prior to installation of the assembly in the bolt hole, (3) a chemical container suitable for storing chemicals under pressure in the container, with its base section composed of material easily penetrated by the puncturing action of the base nut spike flange. The container may be either cylindrical with a hollow center (to surround the roof bolt stem) or semi-cylindrical which type may be attached to the stem of the roof bolt after the roof bolt expansion shell assembly has been attached to stem of the roof bolt. The base configuration of either type container must conform to the configuration of the base spike flange, and the top of the container must conform to the cap of the pressure sleeve, such that upon pressure from the pressure sleeve, the base of the container is forced to contact the spikes of the base nut flange causing the bottom of the container to rupture upon penetration by the spikes, (4) a pressure sleeve consisting of a slotted tubular section with a cup washer at its base. When installed on the stem of the roof bolt below the expansion shell unit, its upper surface (slotted sleeve) contacts the base of the wedge nut of the expansion shell unit. The cup washer serves to hold the top of the chemical container in position so that as the wedge nut (upon tightening the bolt) is forced downward, it forces the pressure sleeve against the top of the chemical container, which inturn is forced down against the spikes in the base of the base spike flange unit. The sleeve is slotted to accomodate the bail of the expansion shell unit.

In one embodiment of the invention, the base flange may have raised spikes with blunt ends that serve to provide a thrust from the flange base upward into a chemical container with a bottom closure consisting of a stopper of friction plug capable of being forced into the container completely, thus exposing the chemicals so they may drop into the bore hole.

DETAILED DESCRIPTION OF THE INVENTION

The invention provides a means of introducing chemicals into a mine roof bolt hole, and by selective engagement with the roof bolt assembly, automatically dispensing the chemicals into the interior of the bolt hole, during the tightening operation of the bolt assembly. The chemicals to be dispensed by the invention are sealants, fillers, desiccants and oxidants etc. for the purpose of counteracting the adverse effects of ambient mine air on the bolt hole strata exposed, and to prevent the escape from the bolt hole of innate gases and moisture confined in the strata in their natural state; the escape of gases and moisture from the roof strata causes changes in the load bearing characteristics and also such toxic gases are a safety hazard to mining operations.

All metal parts of the invention (except the chemical container) are to be manufactured in accordance with ANSI/ASTM Specification F 432 "Roof and Rock Bolts and Accessories." The chemical container may be manufactured from metal (steel, aluminum, etc.) or from a fire retardant plastic, such as polyurethane or Teflon, that will conform to the standards published by the U.S. Mine Health and Safety Administration (MSHA) titled "Interim Fire and Toxicity Criteria For Acceptance of Products Taken into Underground Mines" (current draft is dated Mar. 22, 1977).

Figure 1:
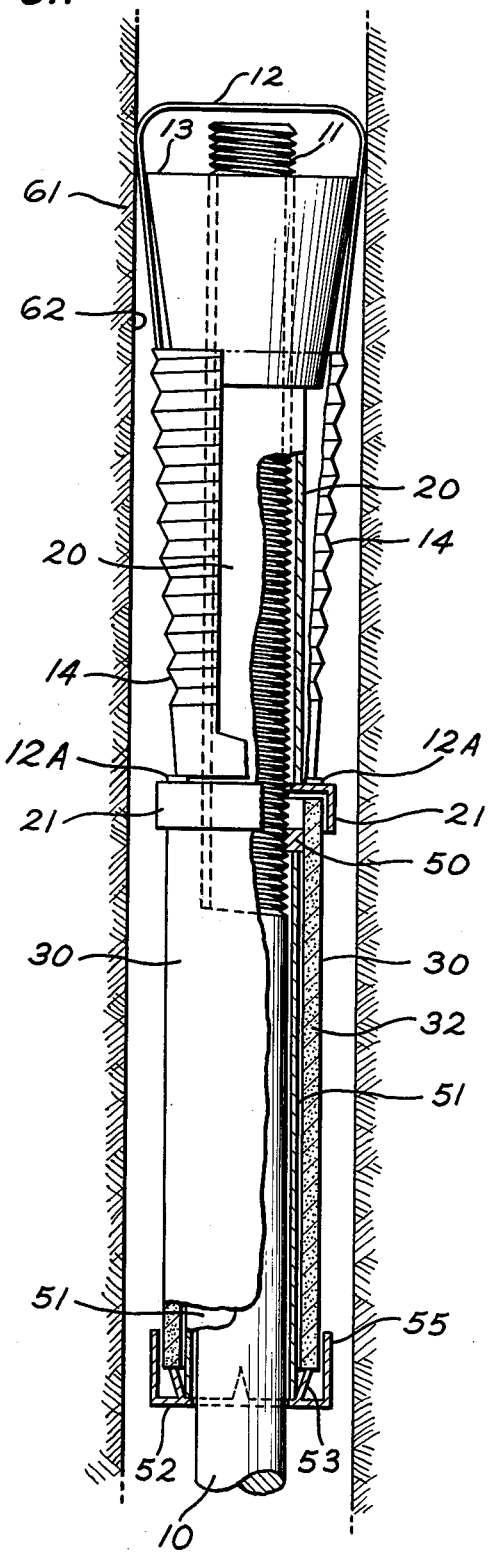
FIG. 1 A partial sectional view illustrating the expansion shell and upper part of mine roof bolt assembly installed in a bore hole in a mine roof strata with the spike chemical dispenser in position.
Figure 2:
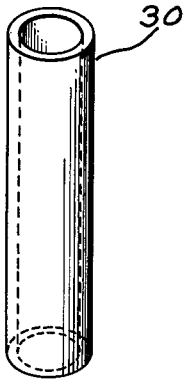
FIG. 2 A perspective view of the cylindrical shaped chemical container with hollow center that hold chemicals. This type container fits around the stem of the roof bolt.
Figure 3:
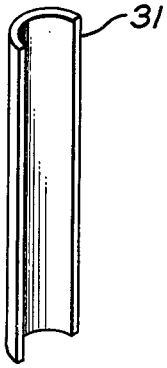
FIG. 3 A perspective view of an alternate type semi-cylindrical chemical container FIG. 4 A partial sectional view of the spike chemical dispenser assembly installed on the stem of a mine roof bolt.
Figure 4:
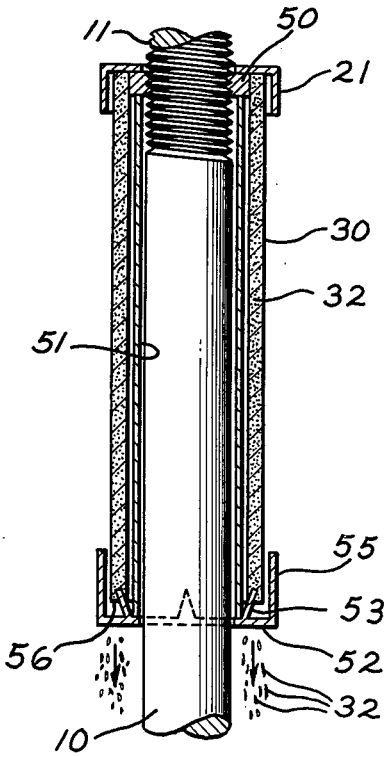
Figure 5:
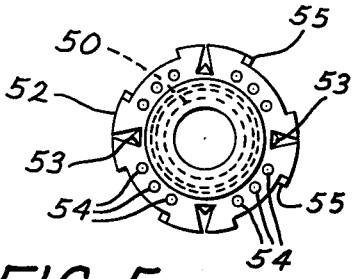
FIG. 5 A top view of the base spike flange unit.
Figure 6:
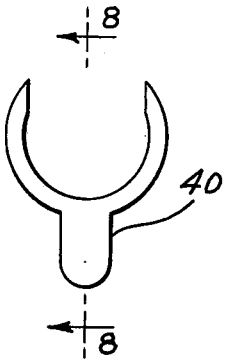
FIG. 6 A top view of the protective "U" washer.
Figure 7:
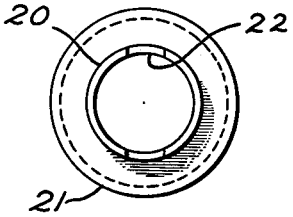
FIG. 7 A top view of the slotted pressure sleeve.
Figure 8:
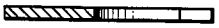
FIG. 8 A sectional view of the protective "U" washer.
Figure 9:
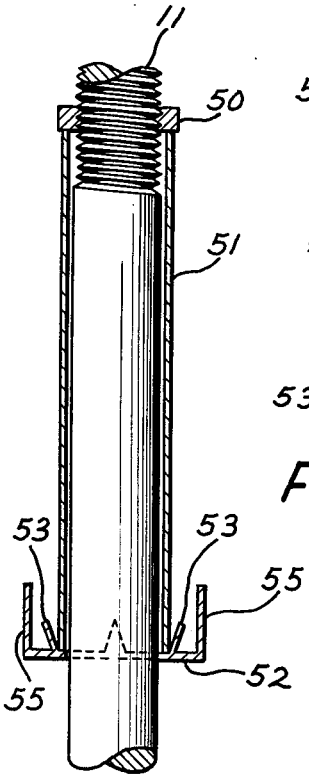
FIG. 9 A partial sectional view of the base spike flange unit mounted on a roof bolt.
Figure 10:
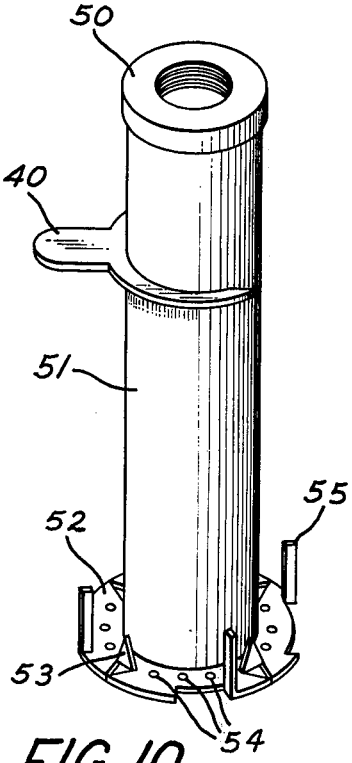
FIG. 10 A perspective view of the base spike flange unit and the protective "U" washer.
Figure 12:
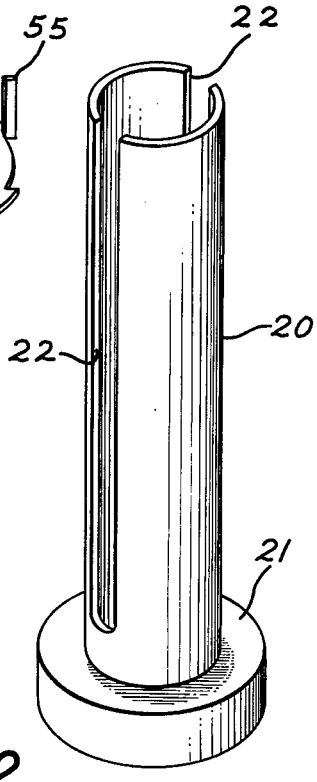
FIG. 12 A persective view of the slotted pressure sleeve.
Figure 11:
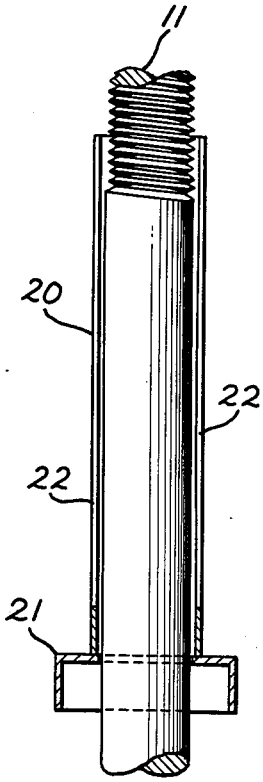
FIG. 11 A partial sectional view of the slotted pressure sleeve.

Referring to FIG. 1, the upper part of a mine roof bolt assembly with spike chemical dispenser assembly attached is shown located within a roof bolt hole 61. The roof bolt assembly includes a stem 10 with a threaded end 11. The expansion shell 14 is inserted over the bolt stem 10 and wedge nut 13 is screwed onto/the threaded end 11 of the stem 10, the bail and stabilizer 12 holds the expansion assembly together and its lower end 12-A grasps the lower part of the expansion shell 14, the bail also serves to force the expansion shell wings 14 to expand when the upper end of the threaded section of the bolt stem 11 comes in contact with the bail-stabilizer 12, by forcing wedge nut 13 downward as the stem 11 is rotated in a tightening motion. The expansion wings 14 when forced against the sides of the bore hole wall 62 cause the assembly to remain firmly anchored. The lower part of the roof bolt assembly contains a base plate (not illustrated) and a base nut (not illustrated) so that as the bolt is tightened at the base nut (by rotation), the pressure exerted on the strata between the base plate and the expansion shell 14 causes the layered roof strata 61 to be squeezed so that the stratified or layered roof strata are prevented from separating or slipping against each other (layered strata), which improves the strength and load bearing characteristic of the bolted strata. According to the invention, the element 50 is a threaded nut, and the base spike flange unit 50,51,52,53,55 is threaded onto the stem of the roof bolt 10,11 until it is seated at the lower part of the threaded section 11 of the roof bolt stem, the base spike flange unit extends downward below the base of the threaded section 11 of the roof bolt stem. The base flange unit has a base flange washer 52 with an integral elongated sleeve 51 having the threaded nut 50 mounted on its top portion. The base flange washer has a plurality of lanced spikes 53 and a plurality of holes 54 and 56 and a plurality of support arms 55 around the periphery of the base flange washer. The chemical container 30 or 31, filled with appropriate chemicals 32 is then lowered down over the end of the roof bolt stem 11 until it seats on the spikes 53 of base flange 52. The slotted pressure sleeve is shown in FIGS. 1, 7, 11 and 12 with a slotted tubular section 20 having longitudinal slots 22 and an inverted cup washer or cap 21 at its lower end to telescope over the top portion of the container. This pressure sleeve is then lowered over the end of the bolt stem 11 until it rests on top of the chemical container 30. The roof bolt expansion assembly 12,13,14 is then threaded onto the end of the roof bolt stem 11 until the wedge nut 13 comes in contact with the top of the slotted pressure sleeve 20,21 (FIG. 1, FIG. 7, FIG. 11). The bolt assembly 12,13,14 with the spike chemical dispenser assembly 20,21,30,(31 of FIG. 3),50,51,52,53,55 is then inserted into the bolt hole. As the bolt stem 11 is tightened (rotated) in the hole, wedge nut 13 is forced down the stem 11, in turn forcing the pressure sleeve 20,21 against the chemical container 30,(31 of FIG. 3) which is forced against the spikes 53 fo the base, spike flange 52,55, causing spikes 53 to penetrate the base of the chemical container 30,(31 of FIG. 3) by piercing holes 56 in the base of the container 30,(31 of FIG. 3) which permits the escape, either by pressure or by gravity, of chemicals 32 from the container 30,(31 of FIG. 3) either through the slots and holes 54 (of FIG. 5) in the base flange 52 or around the edges of flange 52 into the interior of the bolt hole. In FIGS. 6, 8 and 10 is shown a temporary protective blocking means 40 in the form of a U shaped washer or clip that may be interposed between the spikes 53 and the bottom portion of the chemical container 30 or 31 to prevent inadvertent rupturing of the chemical container during non-use of the mine roof bolt assembly.

I claim:

1. In combination with an expansion type mine roof bolt assembly, including a roof bolt having a stem, a roof bolt base plate, and a roof bolt expansion shell unit adapted for selective engagement with a roof bolt hole drilled in a mine roof, a chemical dispenser assembly comprising:

a. a base flange unit which is supported from the threaded upper part of the stem of the mine roof bolt;

b. a chemical container inserted down over the stem of the roof bolt and placed in position on top of the base flange unit, the container having a cavity for storage of chemicals, c. a pressure sleeve unit which is slipped over the upper threaded portion of the roof bolt stem so that it may slide freely along the roof bolt stem, and being in a selective relationship between the roof bolt expansion shell assembly and the top of the chemical container, whereby upon tightening the roof bolt the pressure sleeve transmits a rupture force to the chemical container to cause the contents of the container to be expelled into the roof bolt hole.

2. The invention of claim 1 wherein said pressure sleeve acts in selective engagement with the roof bolt expansion shell unit and serves to transmit the thrust motion of the expansion shell unit to the top of the chemical container, and in turn to the base flange unit.

3. The invention of claim 1, where said chemical container holds chemical substances sealed under containment until released, said base flange unit comprising a lower base flange washer and an upper elongated sleeve that is integral with the washer, the top portion of the elongated sleeve including a threaded nut for engagement with the stem of the roof bolt, the base flange washer including perforations and spike members on which the bottom section of the chemical container are supported, whereby upon tightening the roof bolt the spike members serve to rupture the bottom of the chemical container and permit the released chemicals to fall through the perforations.

4. The invention of claim 1 wherein said base flange unit includes an elongated sleeve that is threaded to the stem of the mine roof bolt, as well as rupture means engageable with the bottom portion of the chemical container for sealing the base of the roof bolt hole.

5. The invention of claim 3 wherein a protective blocking means is temporarily interposed between the spike members and the bottom portion of the chemical container to prevent inadvertent rupturing of the container during non-use of the mine roof bolt assembly.

6. The invention of claim 5 wherein the said protective blocking means is a U washer that is easily detachable from the base flange unit before inserting the mine roof bolt assembly into a mine roof hole.

7. The invention of claim 1 wherein the said chemical container is a hollow cylindrical member.

8. The invention of claim 1 wherein the said chemical container is a semi-cylindrical container that is capable of slipping onto the side of the stem of the said roof bolt.

9. The invention of claim 1 wherein the said pressure sleeve unit is slotted longitudinally, and the bottom portion of this sleeve is provided with a cap that telescopes over the top portion of the said chemical container.

* * * * *